US010655619B2

(12) United States Patent
Sasa et al.

(10) Patent No.: US 10,655,619 B2
(45) Date of Patent: May 19, 2020

(54) PUMP, PUMP DEVICE, AND LIQUID SUPPLY SYSTEM

(71) Applicant: Tokyo Electron Limited, Tokyo (JP)

(72) Inventors: Takashi Sasa, Koshi (JP); Daisuke Ishimaru, Koshi (JP); Takahiro Okubo, Koshi (JP); Tomoyuki Yumoto, Koshi (JP); Tomohiko Muta, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 0 days.

(21) Appl. No.: 14/918,707

(22) Filed: Oct. 21, 2015

(65) Prior Publication Data

US 2016/0115952 A1 Apr. 28, 2016

(30) Foreign Application Priority Data

Oct. 23, 2014 (JP) ..... 2014-216312
Jul. 22, 2015 (JP) ..... 2015-144946

(51) Int. Cl.

*F04B 43/10* (2006.01)
*F04B 15/02* (2006.01)
*F04B 43/00* (2006.01)
*F04B 43/08* (2006.01)

(52) U.S. Cl.

CPC ..... *F04B 43/10* (2013.01); *F04B 15/02* (2013.01); *F04B 43/0072* (2013.01); *F04B 43/08* (2013.01)

(58) Field of Classification Search

CPC ..... F04B 43/0063; F04B 43/0072; F04B 43/084; F04B 43/00; F04B 43/08; F04B 43/10

USPC ..... 137/208

See application file for complete search history.

(56) References Cited

U.S. PATENT DOCUMENTS 5,303,731 A * 4/1994 Vavra ..... G01F 1/50 137/468
5,599,394 A * 2/1997 Yabe ..... B05C 11/08 118/319
6,056,998 A * 5/2000 Fujimoto ..... H01L 21/6715 118/319
6,183,223 B1 * 2/2001 Yajima ..... F04B 43/107 417/478
6,790,283 B2 * 9/2004 Hayashi ..... H01L 21/6715 118/665
2003/0210985 A1 * 11/2003 Feygin ..... B67D 7/00 417/46

(Continued)

FOREIGN PATENT DOCUMENTS

JP S61-097597 U 6/1986
JP 07324680 A * 12/1995
JP 2001-520723 A 10/2001

(Continued)

*Primary Examiner* — Patrick Hamo
*Assistant Examiner* — Chirag Jariwala
(74) *Attorney, Agent, or Firm* — Pearne & Gordon LLP

(57) ABSTRACT

A stay of a liquid can be suppressed. A pump 100 includes a tube 102, having elasticity, in which a liquid as a target to be delivered flows; a tube housing 104 which covers an outside of the tube 102 and keeps a gas in an inner space V between an outer surface of the tube 102 and the tube housing 104; and an electropneumatic regulator RE configured to supply the gas into the inner space V and discharge the gas from the inner space V.

7 Claims, 14 Drawing Sheets

(56) References Cited

U.S. PATENT DOCUMENTS

2005/0238504 A1* 10/2005 Yajima ..... F04B 43/0081
417/394

FOREIGN PATENT DOCUMENTS

| | | | | |
|---|---|---|---|---|
| JP | 2007154767 | A | * | 6/2007 |
| JP | 2008-082289 | A | | 4/2008 |
| JP | 2008-305980 | A | | 12/2008 |
| JP | 2012-071230 | A | | 4/2012 |
| JP | 2012-151197 | A | | 8/2012 |
| TW | I336817 | B | | 2/2011 |
| WO | 99/40321 | A1 | | 8/1999 |
| WO | 2012/042955 | A1 | | 4/2012 |

* cited by examiner

PUMP, PUMP DEVICE, AND LIQUID SUPPLY SYSTEM

CROSS-REFERENCE TO RELATED APPLICATION

This application claims the benefit of Japanese Patent Application Nos. 2014-216312 and 2015-144946 filed on Oct. 23, 2014 and Jul. 22, 2015, respectively, the disclosures of which are incorporated herein by reference.

TECHNICAL FIELD

The embodiments described herein pertain generally to a pump, a pump device, and a liquid supply system.

BACKGROUND

Patent Documents 1 and 2 describe that in the case of performing a microprocessing on a substrate (for example, a semiconductor substrate), a liquid supply system is used to supply a liquid onto a surface of the substrate from a nozzle. A liquid supply system described in Patent Document 1 employs a bellows pump in order to deliver a liquid. A liquid supply system described in Patent Document 2 employs a diaphragm pump in order to deliver a liquid.

Patent Document 1: Japanese Patent Laid-open Publication No. 2008-305980

Patent Document 2: Japanese Patent Laid-open Publication No. 2012-151197

SUMMARY

A bellows pump includes a bellows-shaped bellows in order to suck and discharge a liquid. In a bellows portion of the bellows, when the bellows pump is operated, a thin film member constituting the bellows is folded. For this reason, a narrow space is formed in the vicinity of the bellows portion. As for a diaphragm pump, a thin film having flexibility is provided in a main body in order to suck and discharge a liquid. The thin film becomes closer to the main body when the diaphragm pump is operated. For this reason, a narrow space is also formed in the vicinity of a place where the thin film and the main body are in contact with each other. Therefore, it is easy for a liquid to stay in such narrow spaces.

Generally, a liquid may contain foreign materials such as particles (fine particles). For this reason, if the liquid stays in the narrow space as described above, a concentration of the particles in the liquid is increased. If the liquid with the high concentration of the particles is discharged from a nozzle to a substrate, many particles are attached to the substrate, which may cause defects in the processed substrate.

Therefore, a pump, a pump device, and a liquid supply system capable of suppressing a liquid from staying are described in the present disclosure.

In one exemplary embodiment, a pump includes a tube, having elasticity, in which a liquid as a target to be delivered flows; a tube housing which covers an outside of the tube and keeps a gas in an inner space between an outer surface of the tube and the tube housing; and a supply/discharge unit configured to supply the gas into the inner space and discharge the gas from the inner space.

In the pump, by supplying or discharging a gas into/from the inner space through the supply/discharge unit, a pressure around the tube is increased or decreased. For this reason, when the pressure around the tube is increased, the tube is crushed, so that the liquid within the tube is pushed out of the tube. Meanwhile, when the pressure around the tube is decreased, the tube is expanded and the inside of the tube is filled with the liquid. As compared with a bellows pump or a diaphragm pump, the tube has fewer narrow spaces where it is easy for the liquid to stay. Accordingly, it is possible to suppress the stay of the liquid. Therefore, a concentration of particles in the liquid is not easily increased. Further, in the pump, a gas pressure is applied to the tube in order to deliver the liquid. For this reason, as compared with a case where a liquid pressure is applied to the tube, a configuration can be further simplified.

The tube may include recessed grooves which are extended along a central axis of the tube and recessed toward the central axis. In this case, a portion of the tube in the vicinity of the recessed grooves is easily deformed. Therefore, if the pressure around the tube is increased or decreased, the portion of the tube in the vicinity of the recessed grooves is crushed or expanded in a radial direction of the tube prior to the other portions. For this reason, in the tube including the recessed grooves, the tube is likely to be continuously deformed in the vicinity of the recessed grooves according to a gas pressure around the tube, so that it is possible to suppress a sudden deformation of the tube.

The tube may be extended to penetrate the tube housing, and a portion of the tube including the recessed grooves may be positioned within the tube housing. If the tube does not penetrate the tube housing, a connecting member for connecting the tube to another liquid delivery line is required to be provided at an inlet/outlet opening of the tube housing. Therefore, a narrow space may be formed in the connecting member. However, if the tube is extended to penetrate the tube housing, the connecting member is not needed and such a narrow space is not easily formed. Therefore, it is possible to further suppress the stay of the liquid.

The tube may include three recessed grooves, and the three recessed grooves may be arranged to be approximately equi-spaced in a circumferential direction of the tube. In this case, recessed portions and protruded portions are alternately arranged to be approximately equi-spaced along the circumferential direction of the tube. For this reason, if the pressure around the tube is increased, the tube is approximately uniformly crushed in the circumferential direction of the tube. Therefore, it is difficult for the tube to be locally and severely deformed, so that an excessive stress is not easily applied to the tube. Further, since the tube includes the three recessed grooves, it is possible to scale down the tube while securing a deformation amount of the tube. Furthermore, since the tube includes the three recessed grooves, the tube is likely to be continuously deformed according to the gas pressure around the tube, so that a sudden deformation of the tube is not easily generated. Therefore, it is possible to stably control a status of the tube.

In another exemplary embodiment, a pump device includes the above-described pump; and a housing including a main part and an extension part which has a smaller thickness than the main part and is extended outwardly from the main part. Here, the main part accommodates the supply/discharge unit, and the extension part accommodates the tube and the tube housing.

The pump device has the same operation and effect as the above-described pump. Meanwhile, it is assumed that if two pump devices are used, the two pump devices are assembled and configured as a pair or a set of pump devices. Herein, the pair of pump devices may have a large volume depending on an assembling method of the two pump devices. However, as for the pump device, the extension part of the housing accommodates the tube and the tube housing therein. For this reason, in a state where the main parts of the two pump devices are not overlapped with each other, it is possible to scale down the pair of pump devices as a whole with a small thickness of the pair of pump devices by overlapping the extension parts having small thicknesses are overlapped with each other, though the entire length of the assembled pump devices.

In yet another exemplary embodiment, a liquid supply system includes the above-described pump; a first liquid delivery line connecting the pump to a liquid source; a second liquid delivery line connecting the pump to a nozzle through which a liquid is discharged; and a third liquid delivery line extended with the pump. Further at least a portion of the third liquid delivery line is constituted by the tube.

The liquid supply system has the same operation and effect as the above-described pump.

The liquid supply system may further include a filter provided on the first liquid delivery line; and an assist pump provided on the first liquid delivery line between the filter and the liquid source. If the filter is provided on the first liquid delivery line, the filter is arranged at an upstream side of the pump. Further, there is a pressure loss between an inlet side and an outlet side of the filter. As a result, depending on a viscosity of the liquid, the liquid may be foamed or a discharge amount of the liquid from the pump may be decreased due to lack of suction force of the pump. However, since the assist pump is provided on the first liquid delivery line between the filter and liquid source, the liquid to which a pressure by the assist pump is applied can be delivered to the filter or the pump at a downstream side. For this reason, the liquid is likely to have a positive pressure at the downstream side of the assist pump. Therefore, even if a pressure of the liquid is decreased at the downstream side of the filter due to the pressure loss, the liquid is likely to have a positive pressure at the downstream side of the filter. As a result, even if the liquid has a middle or high viscosity, it is possible to suppress the discharge amount of the liquid from the pump from being decreased or the liquid from being foamed while removing the foreign materials in the liquid with the filter.

An inlet opening of the assist pump for the liquid and a discharge opening of the liquid source for the liquid may be formed as one body. When the assist pump is operated, a pressure at an upstream side of the pump may be decreased and a negative pressure may be generated, so that the liquid may be foamed. However, in this case, since the inlet opening of the assist pump and the discharge opening of the liquid source are formed as one body and thus very close to each other, a space where a negative pressure can be generated is not formed. Therefore, it is possible to further suppress the liquid from being foamed.

According to the above-described pump, pump device and liquid supply system, it is possible to suppress the stay of a liquid.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
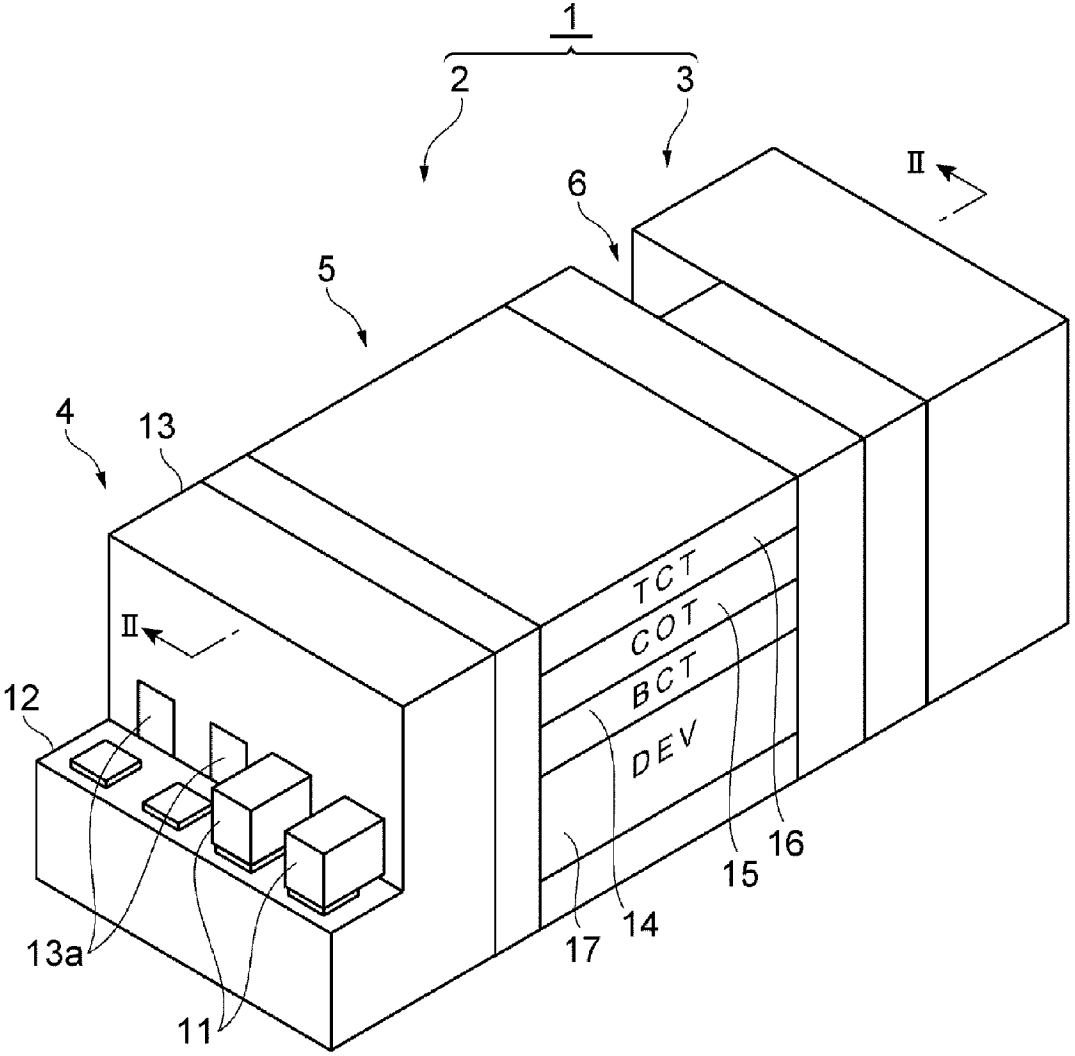
FIG. 1 is a perspective view illustrating a substrate processing system.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current exemplary embodiment. Still, the exemplary embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

<Configuration of Substrate Processing System>

A substrate processing system 1 includes a coating and developing device 2 and an exposure device 3. The exposure device 3 is configured to perform an exposure process on a resist film. To be specific, the exposure device 3 is configured to irradiate an energy line to a portion as an exposure target in the resist film (photosensitive film) by immersion lithography or the like. The energy line may include, for example, an ArF excimer laser, a KrF excimer laser, a g-ray, an i-ray, or an extreme ultraviolet (EUV) ray.

The coating and developing device 2 is configured to form a resist film on a surface of a wafer W (substrate) before the exposure process by the exposure device 3, and also perform a developing process of the resist film after the exposure process. In the present exemplary embodiment, the wafer W has a circular plate shape. However, there may be used a wafer having a circular shape of which a part is notched or having other polygonal shapes instead of the circular shape. The wafer W may include, for example, a semiconductor substrate, a glass substrate, a mask substrate, an FPD (Flat Panel Display) substrate, and various other substrates.

Figure 2:
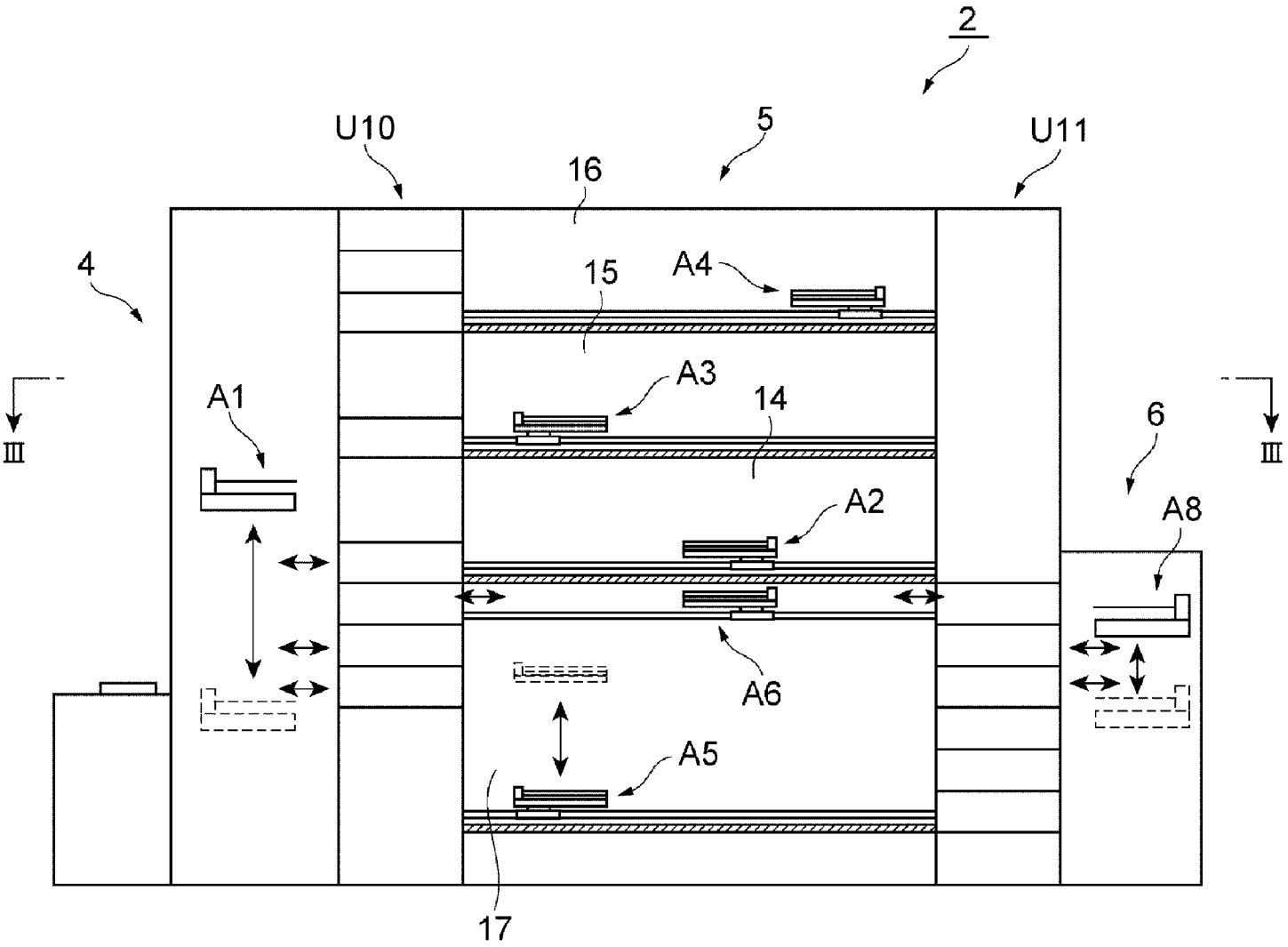
FIG. 2 is a cross-sectional view taken along a line II-II of FIG. 1.
Figure 3:
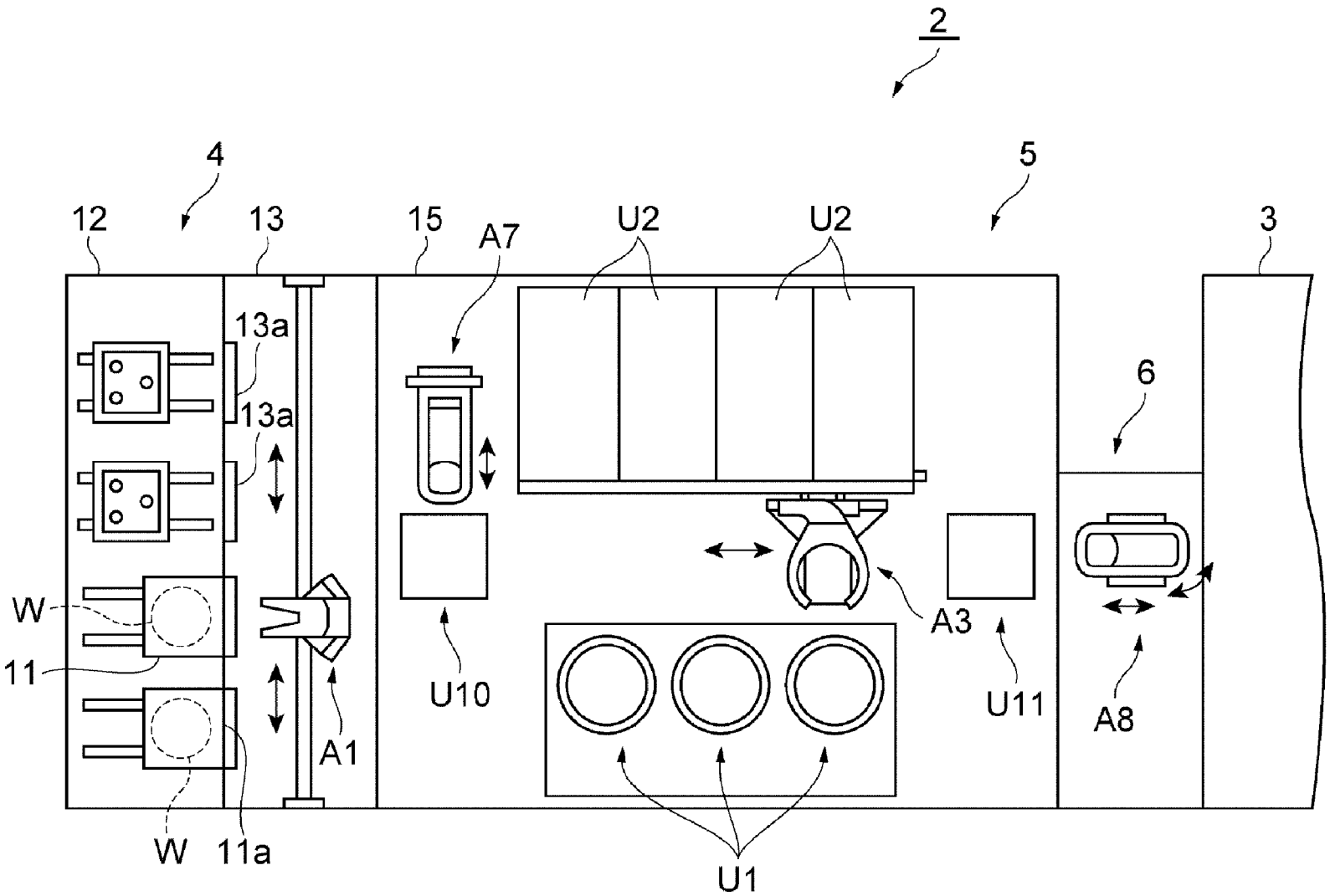
FIG. 3 is a cross-sectional view taken along a line III-III of FIG. 2.

As illustrated in FIG. 1 to FIG. 3, the coating and developing device 2 includes a carrier block 4, a processing block 5, and an interface block 6. The carrier block 4, the processing block 5, and the interface block 6 are arranged in a horizontal direction.

The carrier block 4 includes a carrier station 12 and a carry-in/out unit 13. The carrier station 12 is configured to support multiple carriers 11. The carrier 11 is configured to accommodate, for example, multiple wafers W in a sealing state, and includes an opening/closing door (not illustrated) for carrying in/out the wafer W at its side surface 11*a* (see FIG. 3). The carrier 11 is detachably provided on the carrier station 12 such that the side surface 11*a* is in contact with a side of the carry-in/out unit 13.

The carry-in/out unit 13 is positioned between the carrier station 12 and the processing block 5. The carry-in/out unit 13 includes multiple opening/closing doors 13*a* respectively corresponding to the multiple carriers 11 on the carrier station 12. By opening the opening/closing door on the side surface 11*a* and the opening/closing doors 13*a* at the same time, the inside of the carrier 11 communicates with the inside of the carry-in/out unit 13. A delivery arm A1 is provided in the carry-in/out unit 13. The delivery arm A1 is configured to take out the wafer W from the carrier 11, deliver the wafer W to the processing block 5, receive the wafer W from the processing block 5, and return the wafer W to the inside of the carrier 11.

The processing block 5 includes a BCT module 14, a COT module 15, a TCT module 16, and a DEV module 17. The BCT module 14 is a module for forming a lower film. The COT module 15 is a module for forming a resist film. The TCT module 16 is a module for forming an upper film. The DEV module 17 is a module for performing the developing process. The DEV module 17, the BCT module 14, the COT module 15, and the TCT module 16 are arranged in sequence from a bottom surface side.

The BCT module 14 is configured to form the lower film on the surface of the wafer W. Multiple coating units (not illustrated), multiple heat treatment units (not illustrated), and a delivery arm A2 configured to deliver the wafer W to these units are provided in the BCT module 14. The coating unit is configured to coat a coating liquid for forming the lower film on the surface of the wafer W. The heat treatment unit is configured to perform a heat treatment by heating the wafer W with, for example, a heating plate, and cooling the heated wafer W with, for example, a cooling plate. A specific example of the heat treatment to be performed in the BCT module 14 may include a heating process for forming the lower film by hardening the coating liquid.

The COT module 15 is configured to form the thermosetting or photosensitive resist film on the lower film. Multiple coating units U1, multiple heat treatment units U2, and a delivery arm A3 configured to deliver the wafer W to these units are provided in the COT module 15 (see FIG. 2 and FIG. 3). The coating unit U1 is configured to coat a processing liquid (resist liquid) for forming the resist film on the lower film. The heat treatment unit U2 is configured to perform the heat treatment by heating the wafer W with, for example, a heating plate, and cooling the heated wafer W with, for example, a cooling plate. A specific example of the heat treatment to be performed in the COT module 15 may include a heating (PAB: Pre Applied Bake) process for forming the resist film by hardening the coating liquid.

The TCT module 16 is configured to form the upper film on the resist film. Multiple coating units (not illustrated), multiple heat treatment units (not illustrated), and a delivery arm A4 configured to deliver the wafer W to these units are provided in the TCT module 16. The coating unit is configured to coat a coating liquid for forming the upper film on the surface of the wafer W. The heat treatment unit is configured to perform the heat treatment by heating the wafer W with, for example, a heating plate, and cooling the heated wafer W with, for example, a cooling plate. A specific example of the heat treatment to be performed in the TCT module 16 may include a heating process for forming the upper film by hardening the coating liquid.

The DEV module 17 is configured to perform the developing process on an exposed resist film. Multiple developing units (not illustrated), multiple heat treatment units (not illustrated), a delivery arm A5 configured to deliver the wafer W to these units, and a direct delivery arm A6 configured to deliver the wafer W without passing through these units are provided in the DEV module 17. The developing unit is configured to form a resist pattern by partially removing the resist film. The heat treatment unit is configured to perform the heat treatment by heating the wafer W with, for example, a heating plate, and cooling the heated wafer W with, for example, a cooling plate. A specific example of the heat treatment to be performed in the DEV module 17 may include a heating (PEB: Post Exposure Bake) process performed before the developing process and a heating (PB: Post Bake) process performed after the developing process.

A shelf unit U10 is prepared within the processing block 5 at a side of the carrier block 4 (see FIG. 2 and FIG. 3). The shelf unit U10 is provided to reach the TCT module 16 from a bottom surface and the shelf unit U10 includes multiple cells which are vertically arranged. An elevation arm A7 is provided in the vicinity of the shelf unit U10. The elevation arm A7 is configured to move up and down the wafer W between the cells of the shelf unit U10.

A shelf unit U11 is prepared within the processing block 5 at a side of the interface block 6 (see FIG. 2 and FIG. 3). The shelf unit U11 is provided to reach an upper portion of the DEV module 17 from the bottom surface and the shelf unit U10 includes multiple cells which are vertically arranged.

A delivery arm A8 is provided in the interface block 6, and the interface block 6 is connected to the exposure device 3. The delivery arm A8 is configured to take out the wafer W from the shelf unit U11, deliver the wafer W to the exposure device 3, receive the wafer W from the exposure device 3, and return the wafer W to the shelf unit U11.

<Configuration of Coating Unit>

Figure 4:
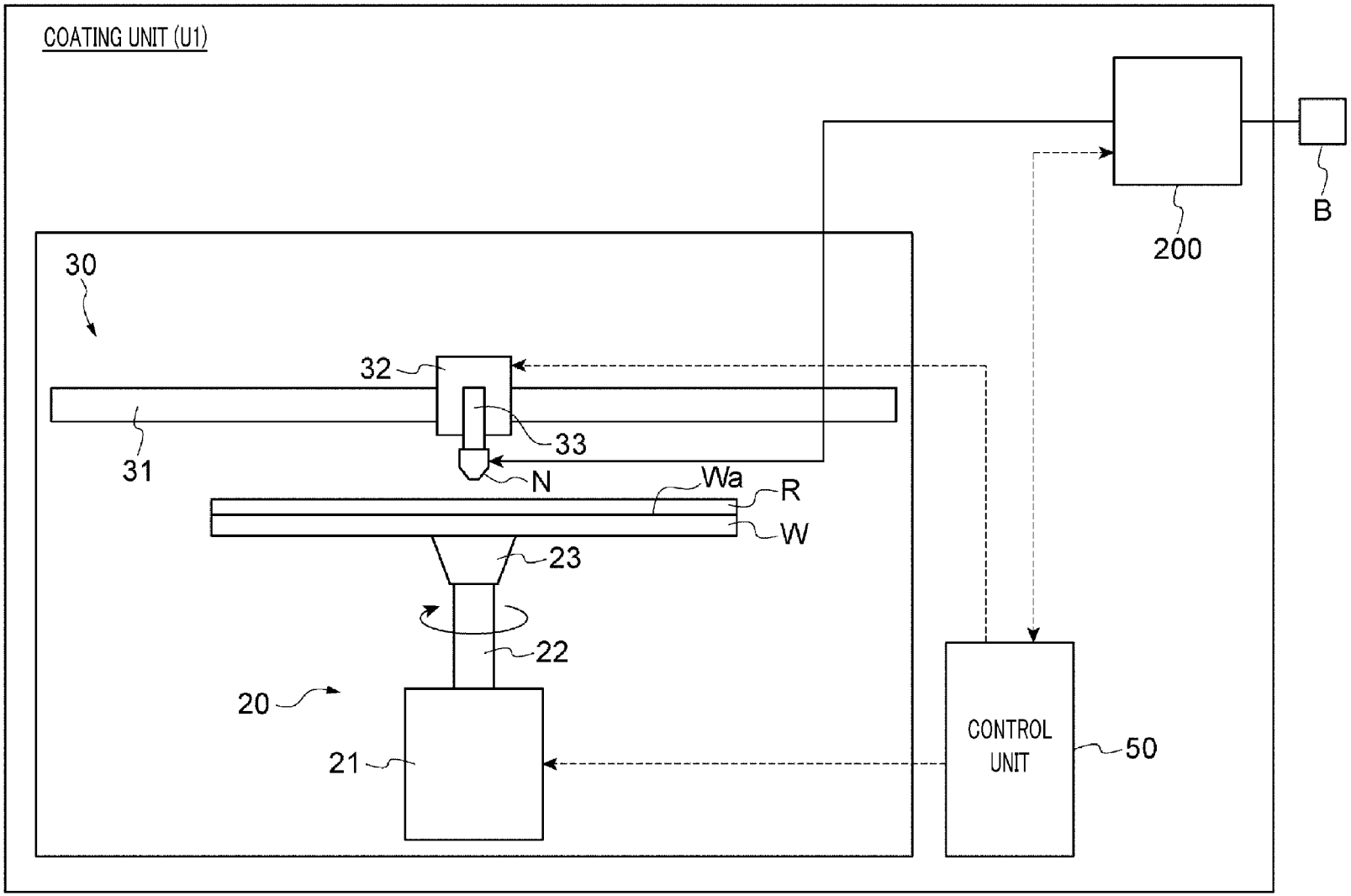
FIG. 4 is a schematic diagram illustrating a coating unit.

Hereinafter, the coating unit (coating device) U1 will be described in more detail with reference to FIG. 4. As illustrated in FIG. 4, the coating unit U1 includes a rotational holding unit 20, a driving unit 30, a pump device 200, and a control unit 50.

The rotational holding unit 20 includes a rotation unit 21 and a holding unit 23. The rotation unit 21 includes a shaft 22 which is upwardly protruded. The rotation unit 21 is configured to rotate the shaft 22 using, for example, an electric motor as a power source. The holding unit 23 is provided at a tip end portion of the shaft 22. The wafer W is placed on the holding unit 23. The holding unit 23 is configured to hold the wafer W in a substantially horizontal posture by, for example, the attraction or the like. That is, the rotational holding unit 20 is configured to rotate the wafer W around an axis (rotation axis) perpendicular to the surface of the wafer W while the wafer W is in a substantially horizontal posture. In the present exemplary embodiment, the rotation axis passes through the center of the wafer W having a circular shape and thus serves as a central axis. In the present exemplary embodiment, the rotational holding unit 20 is configured to rotate the wafer W clockwise when viewed from the top, as illustrated in FIG. 4.

The driving unit 30 is configured to drive a nozzle N. The driving unit 30 includes a guide rail 31, a sliding block 32, and an arm 33. The guide rail 31 is extended in a horizontal direction above the rotational holding unit 20 (wafer W). The sliding block 32 is connected to the guide rail 31 such that the sliding block 32 can be moved in the horizontal direction along the guide rail 31. The arm 33 is connected to the sliding block 32 such that the arm 33 can be moved in a vertical direction. The nozzle N is connected to a lower end of the arm 33.

The driving unit 30 is configured to move the sliding block 32 and the arm 33 using, for example, an electric motor as a power source (not illustrated) and move the nozzle N accordingly. When viewed from the top, the nozzle N is moved along a radial direction of the wafer W on a straight line orthogonal to the rotation axis of the wafer W while discharging the coating liquid.

The pump device 200 is configured to deliver the coating liquid to the nozzle N from a liquid source (for example, a liquid bottle B or a liquid tank T1 to be described later) and discharge the coating liquid from the nozzle N to a surface Wa of the wafer W in response to a control signal from the control unit 50. To be described in detail later, the pump device 200, the nozzle N, and the liquid source are components of the liquid supply system 40 for supplying the coating liquid to a target object (the wafer W in the present exemplary embodiment).

The nozzle N is downwardly opened toward the surface Wa of the wafer W. The coating liquid is a liquid used for forming a coating film R (see FIG. 4) on the surface Wa of the wafer W. Examples of the coating liquid may include a resist liquid for forming a resist pattern or a liquid for forming an anti-reflection film (for example, a bottom anti-reflection coating (BARC) film and a silicon-containing anti-reflection coating (SiARC) film). When a processing liquid dicharged to the surface Wa of the wafer W is dried, the coating film R is formed on the surface Wa of the wafer W, as illustrated in FIG. 4.

The control unit 50 is configured of one or more control computers, and is configured to control the coating unit U1. The control unit 50 includes a display unit (not illustrated) configured to display a control condition setting screen, an input unit (not illustrated) configured to input a control condition, and a reading unit (not illustrated) configured to read a program from a computer-readable storage medium. The storage medium stores therein a program for executing the coating process in the coating unit U1. The program is read by the reading unit of the control unit 50. The storage medium may be, for example, a semiconductor memory, an optical recording disc, a magnetic recording disc, or a magneto-optical recording disc. The control unit 50 is configured to control the coating unit U1 according to the control condition inputted to the input unit and the program read by the reading unit and execute a coating process in the coating unit U1.

<Configuration of Liquid Supply System>

Figure 5:
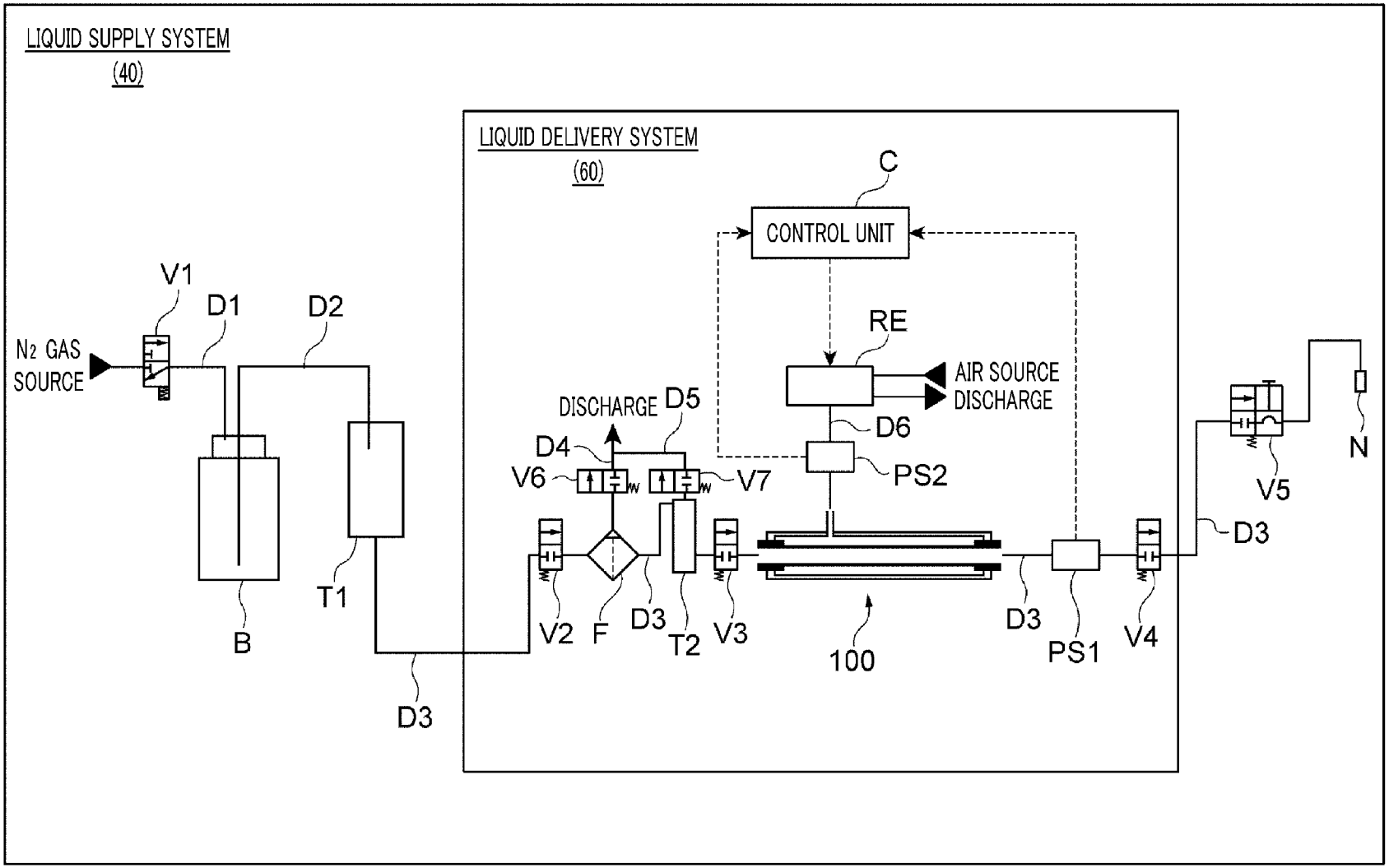
FIG. 5 is a diagram illustrating a liquid supply system.

A configuration of the liquid supply system 40 will be described with reference to FIG. 5. As illustrated in FIG. 5, the liquid supply system 40 includes the liquid bottle B, liquid tanks T1 and T2, a pump 100, a filter device F, lines (liquid delivery lines) D1 to D6, valves V1 to V7, pressure sensors (pressure measurement units) PS1 and PS2, a nozzle N, and a control unit C.

An upstream end of the line D1 is connected to a $N_2$ gas source. A downstream end of the line D1 is connected to a top lid portion of the liquid bottle B such that the downstream end of the line D1 is positioned in the vicinity of a top lid of the liquid bottle B. The liquid bottle B serves as a supply source (liquid source) for supplying the coating liquid to the nozzle N. The valve V1 is provided on the line D1. The valve V1 is an air operation valve configured to open/close (turn on/off) a valve using air.

An upstream end of the line D2 is connected to the top lid portion of the liquid bottle B such that the upstream end of the line D2 is positioned in the vicinity of a bottom of the liquid bottle B. A downstream end of the line D2 is connected to a top lid portion of the liquid tank T1 such that the downstream end of the line D2 is positioned in the vicinity of a top lid of the liquid tank T1. The liquid tank T1 serves as a storage tank configured to temporarily store the coating liquid discharged from the liquid bottle B, and also serves as a supply source (liquid source) for supplying the coating liquid to the nozzle N.

An upstream end of the line D3 is connected to a bottom portion of the liquid tank T1. A downstream end of the line D3 is connected to the nozzle N. The valve V2, the filter device F, the liquid tank T2, the valve V3, the pump 100, the pressure sensor PS1, the valve V4, and the valve V5 are provided on the line D3 in sequence from an upstream side thereof.

The valves V2 to V5 are the same air operation valves as the valve V1. The valve V5 may have a function (flow rate control function) of controlling a flow rate of a coating liquid discharged from the nozzle N to a predetermined level. The valve V5 may have a function (suck back function) of sucking the coating liquid within the nozzle N such that the coating liquid cannot remain in the nozzle N when the discharging of the coating liquid from the nozzle N is stopped.

In the filter device F, a filter configured to remove foreign materials such as particles contained in the coating liquid is provided within a housing. In the liquid tank T2, bubbles remaining within the coating liquid discharged from an outlet of the filter device F are removed. Although will be described in detail later, the pump 100 is configured to suck the coating liquid within the liquid tank T2 and deliver the coating liquid toward the nozzle N. The pressure sensor PS1 is configured to measure a pressure (liquid pressure) of the coating liquid flowing in the pump 100 (the tube 102 to be described later). The pressure sensor PS1 is configured to output a signal indicating a value of the measured liquid pressure to the control unit C.

An upstream end of the line D4 is connected to an exhaust port of the filter device F. A downstream end of the line D4 is connected to the outside of the system. For this reason, a gas separated from the coating liquid when the coating liquid passes through the filter device F is discharged to the outside of the system through the line D4. The valve V6 is provided on the line D4. The valve V6 is the same air operation valve as the valve V1.

An upstream end of the line D5 is connected to an exhaust port of the liquid tank T2. A downstream end of the line D5 is connected to the line D4 at a downstream side of the valve V6. For this reason, a gas separated from the coating liquid in the liquid tank T2 is discharged to the outside of the system through the line D5. The valve V7 is provided on the line D5. The valve V7 is the same air operation valve as the valve V1.

One end of the line D6 is connected to the pump 100 (a tube housing 104 to be described later). The other end of the line D6 is connected to an electropneumatic regulator (supply/discharge unit) RE. The electropneumatic regulator RE includes an electromagnetic valve configured to perform an opening/closing operation in response to a control signal from the control unit C. The electropneumatic regulator RE is configured to suck air from an air source or discharge air to the outside according to an opening degree of the electromagnetic valve. Thus, the electropneumatic regulator RE is configured to adjust an air pressure (a gas pressure) within the pump 100 (within an inner space V to be described later). The pressure sensor PS2 is provided on the line D6. The pressure sensor PS2 is configured to measure the air pressure (the gas pressure) within the pump 100 (within the inner space V to be described later). The pressure sensor PS2 is configured to output a signal indicating a value of the measured gas pressure to the control unit C.

The control unit C is configured of one or more control computers, and is configured to control the electropneumatic regulator RE. The control unit C includes a display unit (not illustrated) configured to display a control condition setting screen, an input unit (not illustrated) configured to input a control condition, and a reading unit (not illustrated) configured to read a program from a computer-readable storage medium. The storage medium stores therein a program for executing the liquid delivery process in the pump 100. The program is read by the reading unit of the control unit C. The storage medium may be, for example, a semiconductor memory, an optical recording disc, a magnetic recording disc, or a magneto-optical recording disc. The control unit C is configured to control the electropneumatic regulator RE according to the control condition inputted to the input unit and the program read by the reading unit and execute a liquid delivery process in the pump 100.

<Configuration of Pump>

Figure 6:
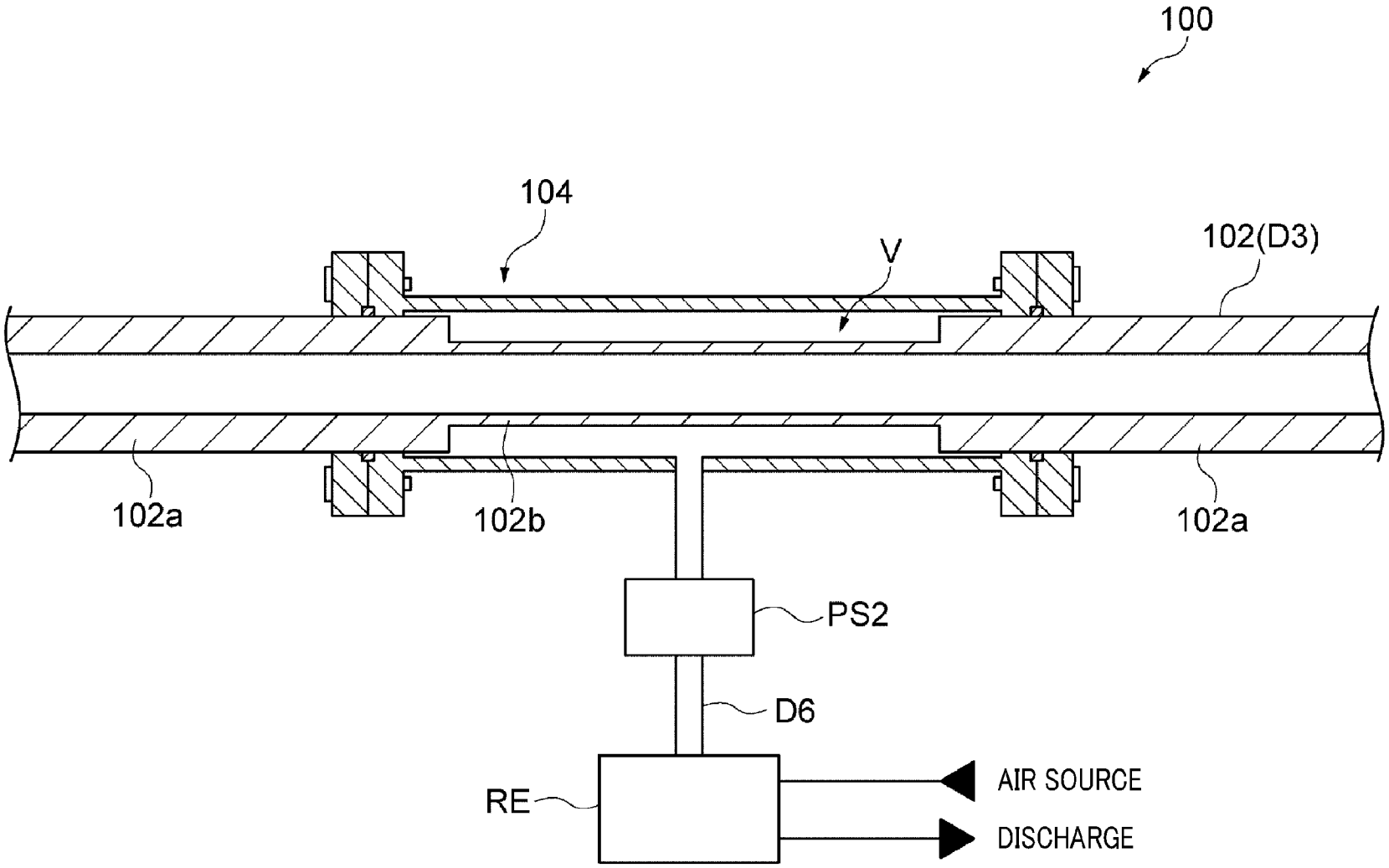
FIG. 6 is a diagram schematically illustrating a cross section of a pump.

Hereinafter, a configuration of the pump 100 will be described with reference to FIG. 6 to FIG. 7B. As illustrated in FIG. 6, the pump 100 includes the tube 102, the tube housing 104, and the above-described electropneumatic regulator RE.

The tube 102 has flexibility and elasticity. That is, the tube 102 has a property of returning to its original shape when an external force is applied to the tube 102 from the inside or the outside. The tube 102 may be formed of, for example, fluorine resin. One end of the tube 102 is connected to the valve V3 (see FIG. 5). The other end of the tube 102 is connected to the pressure sensor PS1 (see FIG. 5). That is, the tube 102 constitutes a part of the line D3. The tube 102 includes a thick portion 102*a* and a thin portion 102*b*, as illustrated in FIG. 6 to FIG. 7B.

The thick portion 102*a* has a cylindrical shape. An outer diameter of the thick portion 102*a* may be, for example, about 12.7 mm. An inner diameter of the thick portion 102*a* may be, for example, about 9.5 mm. A wall thickness of the thick portion 102*a* may be, for example, about 1.6 mm.

The thin portion 102*b* is extended between a pair of thick portions 102*a*. That is, both ends of the thin portion 102*b* are respectively connected to the thick portions 102*a*. A wall thickness of the thin portion 102*b* may be, for example, about 0.2 mm.

Figure 7A:
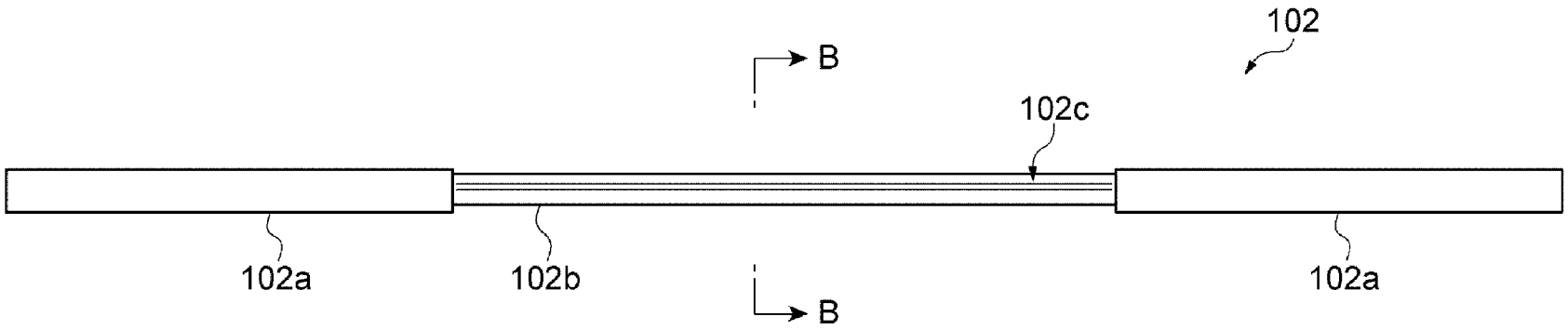
FIG. 7A is a side view illustrating a tube.
Figure 7B:
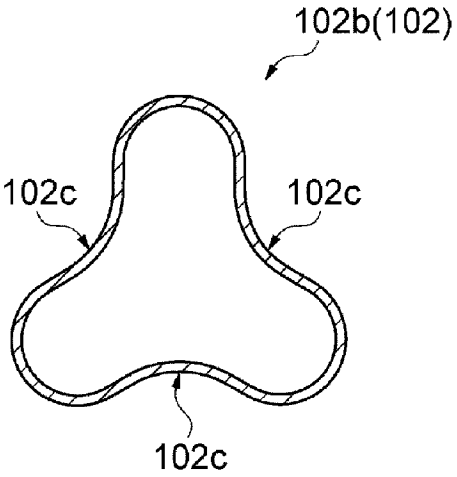
FIG. 7B is a cross-sectional view taken along a line B-B of FIG. 7A.

As illustrated in FIG. 7A and FIG. 7B, the thin portion 102*b* includes a recessed groove 102*c*. The recessed groove 102*c* is extended along a central axis of the tube 102 (an extension direction of the tube 102). The recessed groove 102*c* is recessed toward the central axis of the tube 102 (an inside of the tube 102). The thin portion 102*b* (tube 102) may include multiple recessed grooves 102*c*. In the present exemplary embodiment, the thin portion 102*b* (tube 102) includes three recessed grooves 102*c*. The three recessed grooves 102*c* are arranged to be approximately equi-spaced along a circumferential direction of the tube 102, as illustrated in FIG. 7B. That is, in the thin portion 102*b* of the present exemplary embodiment, recessed portions and protruded portions are alternately arranged to be approximately equi-spaced along its circumferential direction.

Returning to FIG. 6, the tube housing 104 has a cylindrical shape. The tube housing 104 accommodates a part of the tube 102 such that the tube housing 104 covers the outside of the tube 102. The tube housing 104 is extended coaxially with respect to the tube 102 along the central axis of the tube 102 (the extension direction of the tube 102). In other words, the tube 102 penetrates the tube housing 104. The thin portion 102*b* of the tube 102 is positioned within the tube housing 104. The inner space V, in which a gas (air) is kept, is formed between an outer surface of the tube 102 and the tube housing 104. One end of the line D6 is connected to the tube housing 104. Thus, the supply of the gas into the inner space V and the discharge of the gas from the inner space V are performed by the electropneumatic regulator RE.

<Pump Device>

In the present exemplary embodiment, some components constituting the above-described liquid supply system 40 also constitute the liquid delivery system 60, as illustrated in FIG. 5. Component constituting the liquid delivery system 60 may include, for example, the pump 100, the filter device F, the control unit C, the pressure sensors PS1 and PS2, the liquid tank T2, the electropneumatic regulator RE, the valves V2 to V4, V6, and V7, a part of the line D3, and the lines D4 and D5. The pump device 200 includes a housing 202 illustrated in FIG. 8 and the components constituting the liquid delivery system 60.

Figure 8:
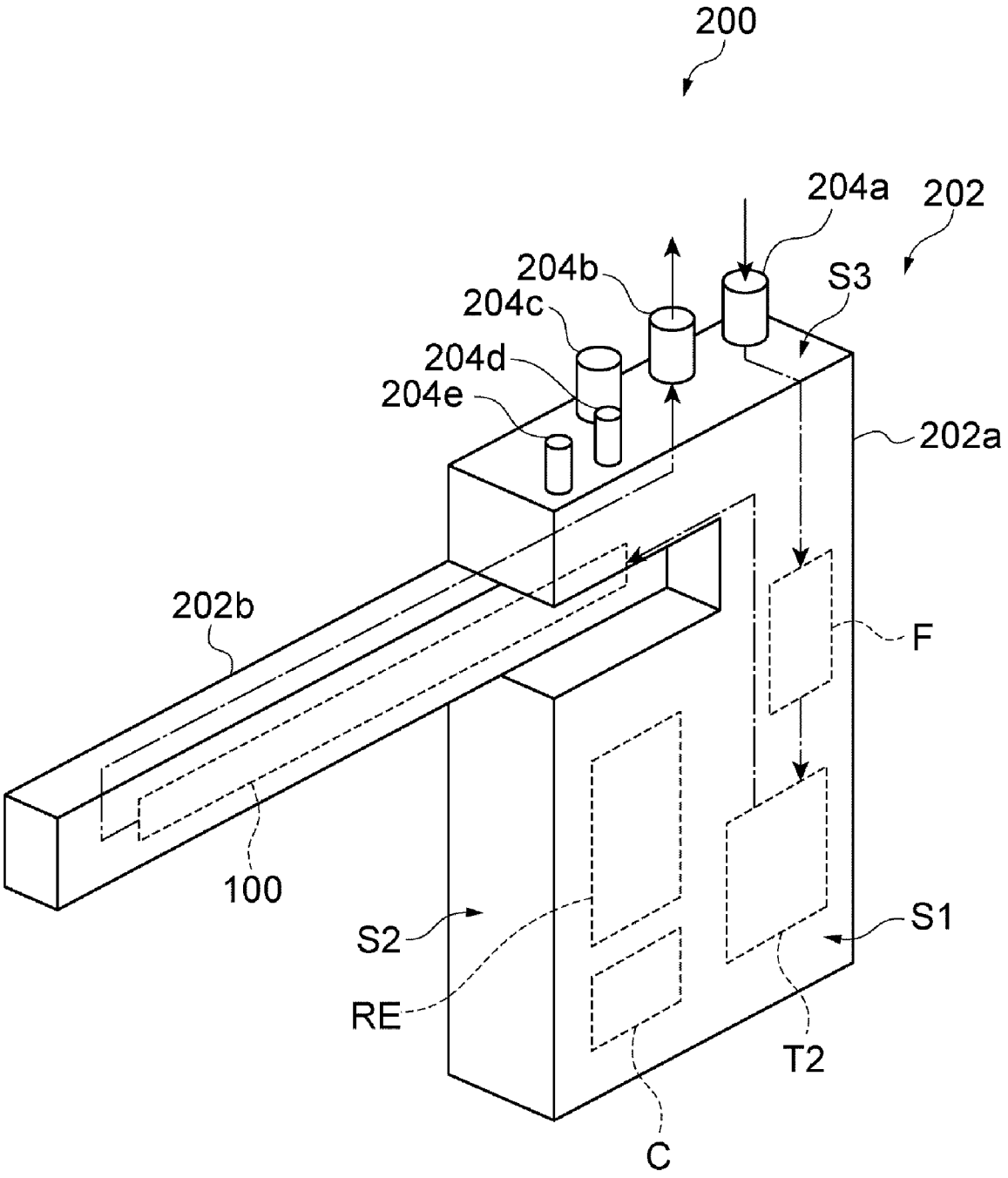
FIG. 8 is a perspective view illustrating a pump device.

The housing 202 includes a main part 202*a* and an extension part 202*b* as illustrated in FIG. 8. The main part 202*a* and the extension part 202*b* are configured as one body. The main part 202*a* has a hexahedral shape. The main part 202*a* includes a pair of main surfaces S1 each having a relatively greater area than the other surfaces; a pair of side surfaces S2; and a pair of end surfaces S3. The main part 202*a* accommodates at least the filter device F, the control unit C, the pressure sensors PS1 and PS2, the liquid tank T2, and the electropneumatic regulator RE among the components constituting the liquid delivery system 60.

The extension part 202*b* is extended in a linear shape from the side surface S2 of the main part 202*a* toward the outside. An extension direction of the extension part 202*b* corresponds to a facing direction of the pair of side surfaces S2 in the present exemplary embodiment. However, the extension direction of the extension part 202*b* is not limited thereto, and may correspond to a direction intersecting or orthogonal to a facing direction of the pair of main surfaces S1. A thickness of the extension part 202*b* in the facing direction of the main surfaces S1 is smaller than a thickness of the main part 202*a* in the same facing direction. The extension part 202*b* accommodates at least the pump 100 among the components constituting the liquid delivery system 60. The pump 100 is arranged within the extension part 202*b* and extended along the extension direction of the extension part 202*b*.

On the end surface S3 of the main part 202*a*, connecting members 204*a* to 204*e* are provided. The connecting member 204*a* is connected, outside the pump device 200, to a line on at upstream side of the pump device 200 (a part of the lines D1, D2, and the line D3 positioned at the upstream side of the pump device 200). The line positioned at the upstream side constitutes an upstream-side liquid delivery line (first liquid delivery line) connecting the liquid bottle B to the pump device 200. For this reason, the coating liquid from the liquid tank T1 is introduced into the pump device 200 through the connecting member 204*a*.

The connecting member 204*b* is connected, outside the pump device 200, to a line at a downstream side of the pump device 200 (a part of the line D3 positioned at the downstream side of the pump device 200). The line positioned at the downstream side constitutes a downstream-side liquid delivery line (second liquid delivery line) connecting the pump device 200 to the nozzle N.

In the pump device 200, the line (a part of the line D3) extended between the connecting member 204*a* and the connecting member 204*b* constitutes a liquid delivery line (third liquid delivery line) extended within the pump device 200. That is, the connecting member 204*a* and the connecting member 204*b* are connected, inside the pump device 200, to the liquid delivery line extended within the pump device 200. A part of the corresponding liquid delivery line is configured of the tube 102. For this reason, the coating liquid delivered from the pump 100 toward the downstream side (the nozzle N side) is discharged to the outside of the pump device 200 through the connecting member 204*b*.

The connecting member 204*c* is connected, outside the pump device 200, to the outside of the system via a non-illustrated line. The connecting member 204*c* is connected, inside the pump device 200, to the downstream end of the line D4. For this reason, a gas within the filter device F or a gas within the liquid tank T2 is discharged to the outside of the pump device 200 through the lines D4 and D5 and the connecting member 204*c*.

The connecting member 204*d* is connected, outside the pump device 200, to an air source via a non-illustrated line. The connecting member 204*e* is connected, outside the pump device 200, to the outside of the system via a non-illustrated line. Each of the connecting members 204*d* and 204*e* is connected, inside the pump device 200, to the electropneumatic regulator RE via a non-illustrated line. For this reason, air from the air source is introduced into the electropneumatic regulator RE through the connecting member 204*d*. The air within the electropneumatic regulator RE is discharged to the outside of the electropneumatic regulator RE (the outside of the pump device 200) through the connecting member 204*e*.

<Operation of Liquid Supply System>

Figure 9:
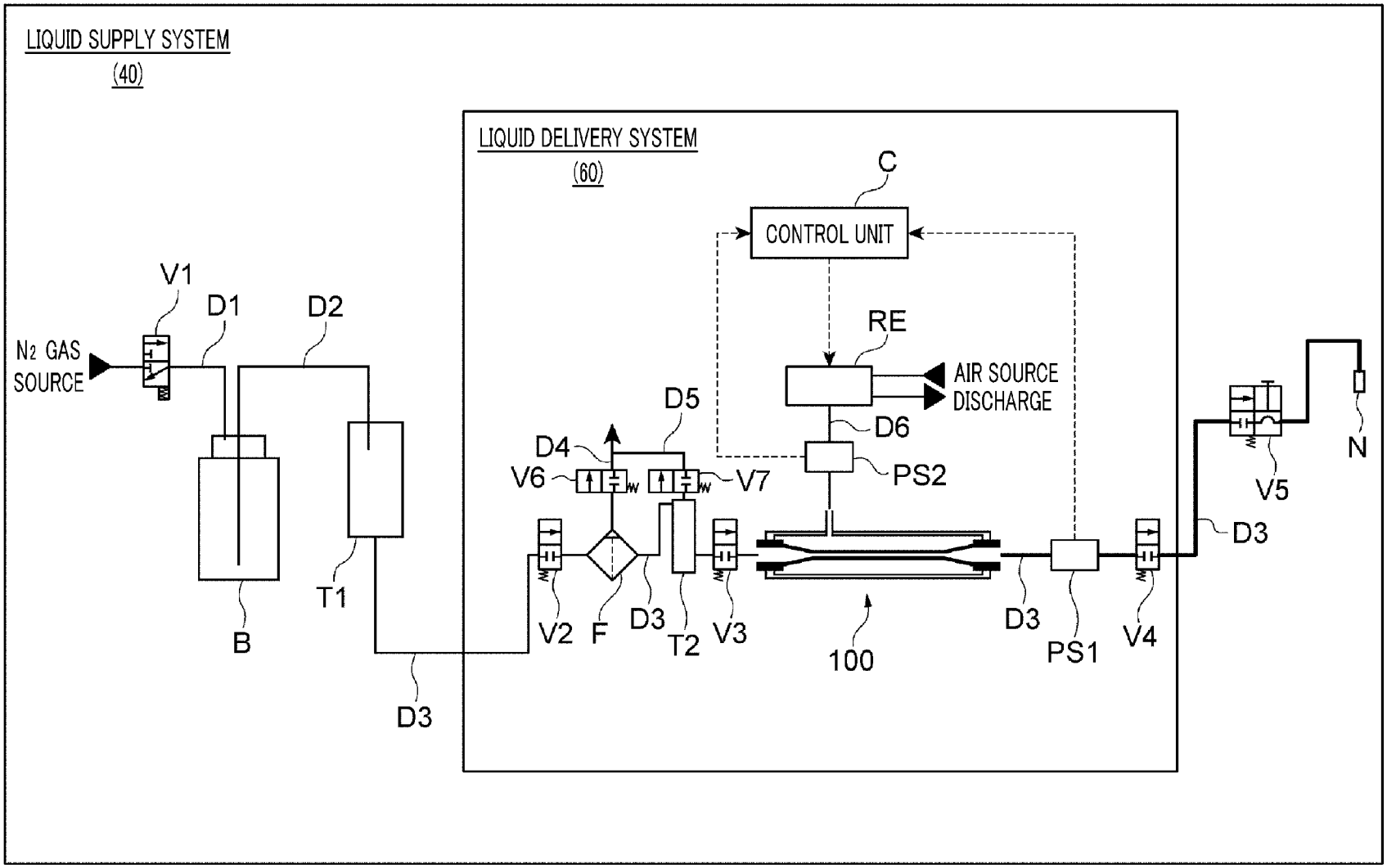
FIG. 9 is a diagram describing an operation of the liquid supply system when discharging a liquid.
Figure 10:
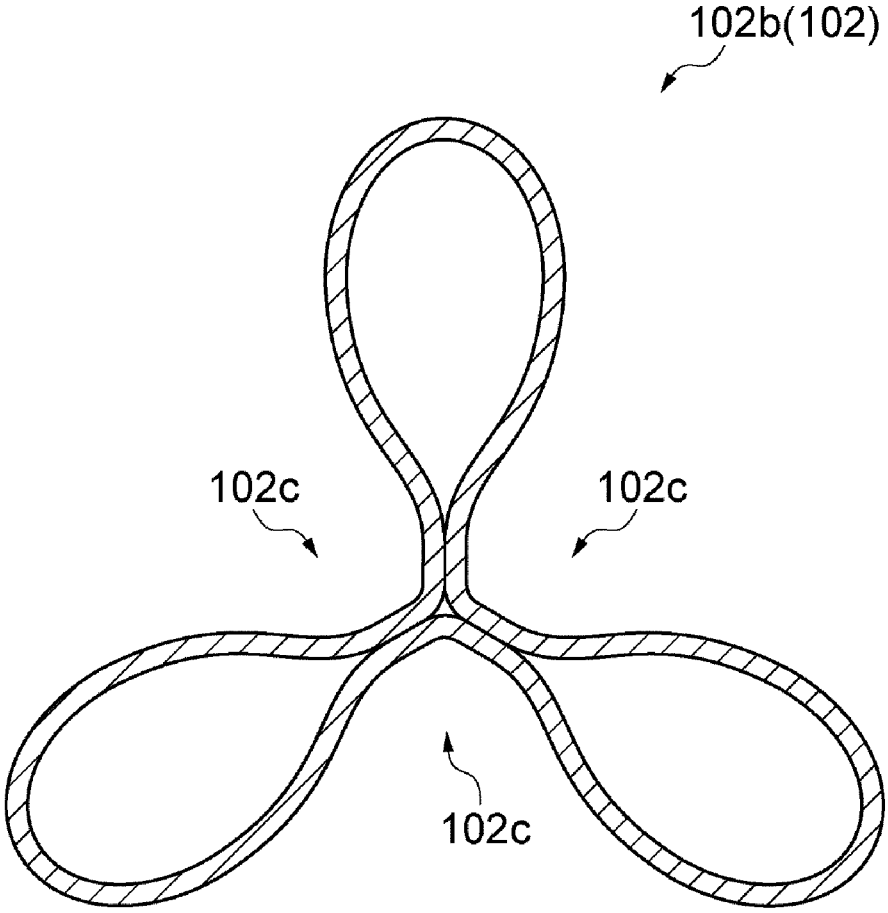
FIG. 10 is a cross-sectional view illustrating a crushed shape of a tube.

Hereinafter, an operation of the liquid supply system 40 (a discharge operation of discharging a coating liquid from the nozzle N) will be described with reference to FIG. 9 and FIG. 10. While the inside of the tube 102 is filled with the coating liquid, the control unit C closes the valves V1 to V3, V6, and V7 and opens the valves V4 and V5, and also operates the electropneumatic regulator RE to supply air into the inner space V. Thus, a pressure within the inner space V is increased, and the thin portion 102*b* of the tube 102 positioned within the inner space V is crushed by an air pressure. When the tube 102 (the thin portion 102*b*) is crushed, the recessed grooves 102*c* of the tube 102 (the thin portion 102*b*) become closer to each other or are brought into contact with each other, as illustrated in FIG. 10. Thus, the volume within the tube 102 (the thin portion 102*b*) is decreased, and the coating liquid within the tube 102 is pushed toward the opened valves V4 and V5. As a result, if the nozzle N is positioned above the wafer W, the coating liquid is discharged from the nozzle N toward the surface Wa of the wafer W.

<Operation Effect>

In the present exemplary embodiment described above, the electropneumatic regulator RE supplies and discharges a gas into/from the inner space V to increase and decrease the pressure around the tube 102. For this reason, when the pressure around the tube 102 is increased, the tube 102 is crushed and the coating liquid (liquid) within the tube 102 is pushed out of the tube 102. Meanwhile, when the pressure around the tube 102 is decreased, the tube 102 is expanded and the inside of the tube 102 is filled with the coating liquid. As compared with a bellows pump or a diaphragm pump, the tube 102 has a small narrow space where it is easy for the coating liquid to stay. For this reason, it is possible to suppress the stay of the coating liquid. Therefore, a concentration of particles in the coating liquid is not easily increased. Further, in the present exemplary embodiment, the air pressure is applied to the tube 102 in order to deliver the coating liquid. For this reason, as compared with the case where the liquid pressure is applied to the tube 102, a configuration can be simplified.

In the present exemplary embodiment, the tube 102 includes the recessed grooves 102*c* which are extended along the central axis and recessed toward the central axis. With the recessed grooves 102*c*, the vicinity of the recessed grooves 102*c* in the tube 102 is easily deformed. Therefore, if the pressure around the tube 102 is increased or decreased, the vicinity of the recessed grooves 102*c* is crushed or expanded in the radial direction of the tube 102 more easily than the other portions. As such, in the tube 102 including the recessed grooves 102*c*, the tube 102 is likely to be continuously deformed in the vicinity of the recessed grooves 102*c* according to the air pressure around the tube 102, and, thus, it is possible to suppress a sudden deformation of the tube 102.

However, if the tube 102 does not penetrate the tube housing 104, connecting members for connecting the tube 102 to another liquid delivery line may be needed at inlet/outlet openings of the tube housing 104. For this reason, there may be a narrow space in the connecting member. However, in the present exemplary embodiment, the tube 102 is extended to penetrate the tube housing 104 and the thin portion 102*b* of the tube 102 is positioned within the tube housing 104. As a result, the above-described connecting member is not needed, and a joint portion for the tube 102 is not formed at a boundary between the inside and the outside of the tube housing 104. Therefore, a narrow space is not easily formed in the tube 102 and in the liquid delivery line constituted, at least in part, by the tube 102. Therefore, it is possible to further suppress the stay of the coating liquid.

In the present exemplary embodiment, the tube 102 includes the three recessed grooves 102*c* and the three recessed grooves 102*c* are arranged to be approximately equi-spaced along the circumferential direction of the tube 102. For this reason, if the pressure around the tube 102 is increased, the tube 102 is approximately uniformly crushed in the circumferential direction of the tube 102. Therefore, it is difficult for the tube 102 to be locally and severely deformed, so that an excessive stress is not easily applied to the tube 102. Further, since the tube 102 includes the three recessed grooves 102*c*, it is possible to scale down the tube 102 while securing the deformation amount of the tube 102. Furthermore, if the tube 102 includes two recessed grooves 102*c* or less, when the pressure around the tube 102 is increased, the walls of the tube 102 are entirely brought into contact with each other, so that it becomes difficult to control the liquid delivery flow rate. If the tube 102 includes four recessed grooves 102*c* or more, it is difficult for the tube 102 to be crushed, and, thus, the tube 102 may be scaled up to solve such a problem.

In the present exemplary embodiment, the inner space V between the tube housing 104 covering the outside of the tube 102 and the outer surface of the tube 102 is filled with air (gas). That is, the air is used as a working fluid for operating the tube 102. For this reason, a mechanism for supplying the air into the inner space V and discharging the air from the inner space V is needed, but a relatively complicated driving mechanism such as a piston or a motor may not be used. Therefore, it is possible to deliver the liquid with a simple configuration.

Another Exemplary Embodiment

Figure 11:
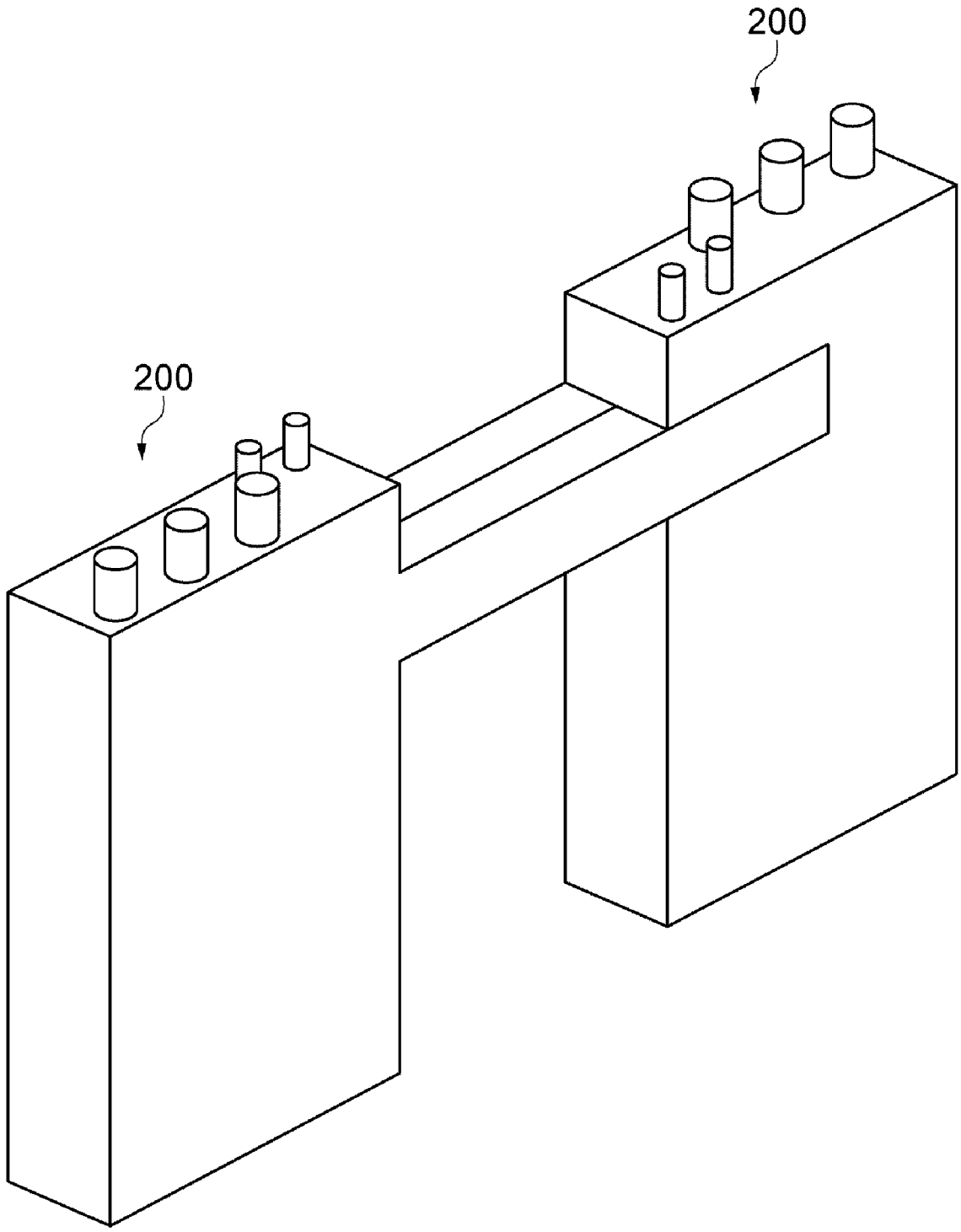
FIG. 11 is a perspective view illustrating a pair of pump devices.

Although the exemplary embodiment has been described in detail, various modifications and changes may be added to the above-described exemplary embodiment within the scope of the present disclosure. By way of example, two pump devices 200 may be combined and used as a pair or a set of pump devices. Herein, a volume of the pair of pump devices may be increased depending on a method of assembling two pump devices. Therefore, as illustrated in FIG. 11, in a state where the main parts 202*a* of the two pump devices 200 are not overlapped with each other, a pair of pump devices may be assembled by overlapping the extension part 202*b* of one pump device 200 with the extension part 202*b* of the other pump device 200. In this case, though the entire length of the assembled pump devices is increased, the extension parts 202*b* having small thicknesses are overlapped with each other. For this reason, it is possible to scale down the pair of pump devices as a whole with a small thickness of the pair of pump devices.

Although the air is supplied into the inner space V by the electropneumatic regulator RE in the present exemplary embodiment, any gas (for example, a nitrogen gas or an inert gas having low chemical reactivity) may be used instead of the air.

Although the present disclosure is applied to the coating unit U1 included in the COT module 15 in the present exemplary embodiment, the present disclosure may be applied to another unit instead of the coating unit U1.

The control unit 50 may serve as the control unit C, or the control unit C may serve as the control unit 50.

An assist pump 300 may be provided on the line D3 between the liquid source (the liquid bottle B or the liquid tank T1) and the filter device F. Since the liquid supply system 40 illustrated in FIG. 12 includes the liquid tank T1 positioned at a downstream side of the liquid bottle B, the assist pump 300 is positioned at a downstream side of the liquid tank T1. However, if the liquid supply system 40 does not include the liquid tank T1, the assist pump 300 may be positioned at the downstream side of the liquid bottle B.

Figure 12:
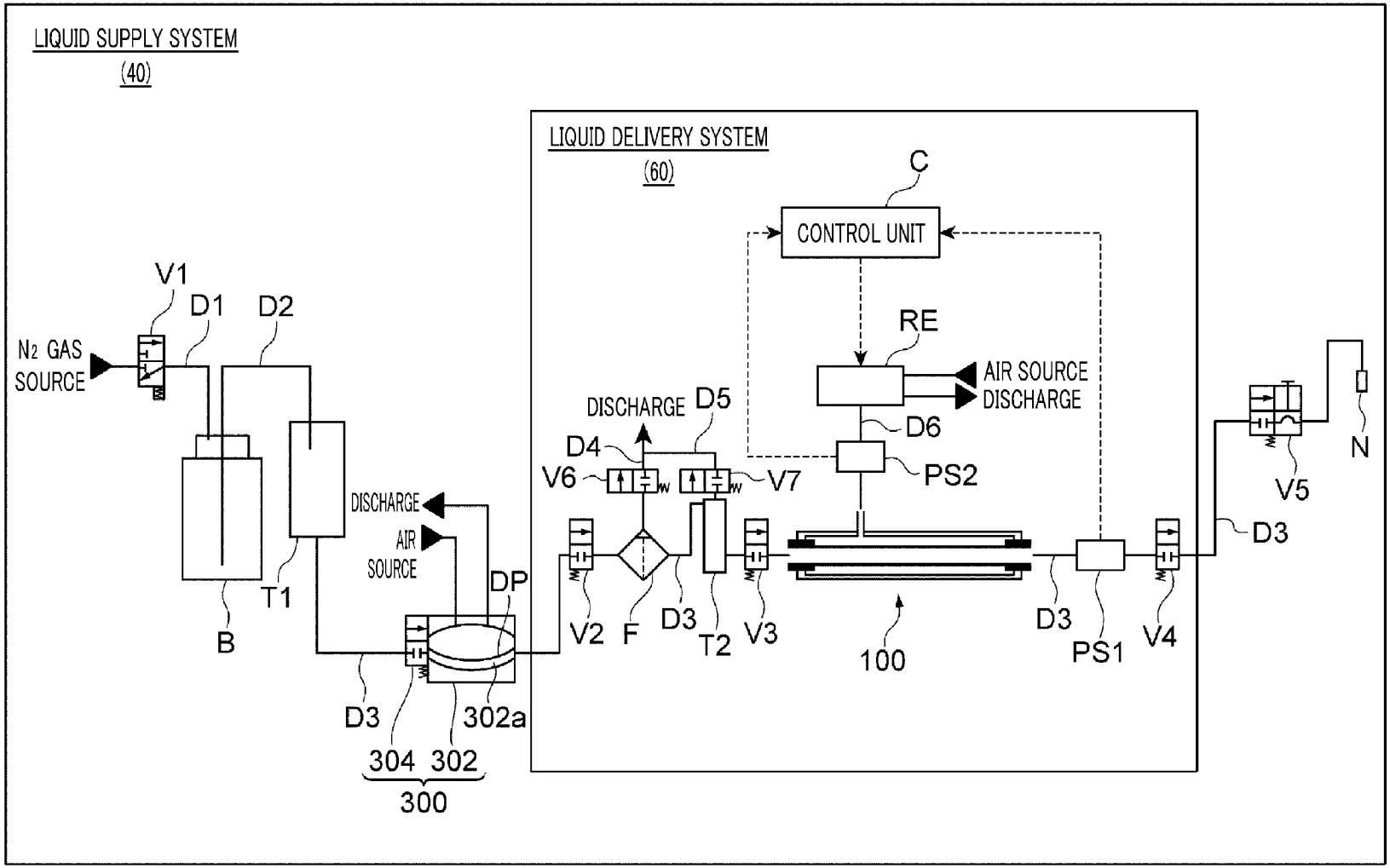
FIG. 12 is a diagram illustrating a liquid supply system in accordance with another exemplary embodiment.

The assist pump 300 includes a pump unit 302 and a valve unit 304. The pump unit 302 may employ, for example, a diaphragm pump as illustrated in FIG. 12, the pump 100 in accordance with the present exemplary embodiment, or another kind of pump. In a case where the pump unit 302 is a diaphragm pump, if the air is introduced from the air source, the diaphragm (DP) is crushed toward an inner side wall of a pump chamber 302*a*. As a result, the volume of the pump chamber 302*a* is decreased and the liquid within the pump chamber 302*a* is discharged to the outside thereof. Meanwhile, if the air is sucked by a vacuum source, the diaphragm (DP) is separated from the inner side wall of the pump chamber 302*a*. As a result, the volume of the pump chamber 302*a* is increased and the liquid is sucked into the pump chamber 302*a*. The valve unit 304 is the same air operation valves as the valve V1.

Hereinafter, operation timings of the pump 100 and the assist pump 300 will be described with reference to FIG. 13. Firstly, at a time point TI1, in a state where the valve V3 is closed (see (B) of FIG. 13), the inside of the inner space V is set to have a positive pressure (see (A) of FIG. 13). Thus, between the time point TI1 and a time point TI2, air is supplied into the inner space V by the electropneumatic regulator RE and the coating liquid is discharged from the pump 100. At this time, in the assist pump 300, in a state where the valve unit 304 is opened (see (D) of FIG. 13), the pump unit 302 (inside the pump chamber 302*a*) is set to have a negative pressure (see (C) of FIG. 13) and the inside of the pump unit 302 is supplemented with the coating liquid.

Figure 13:
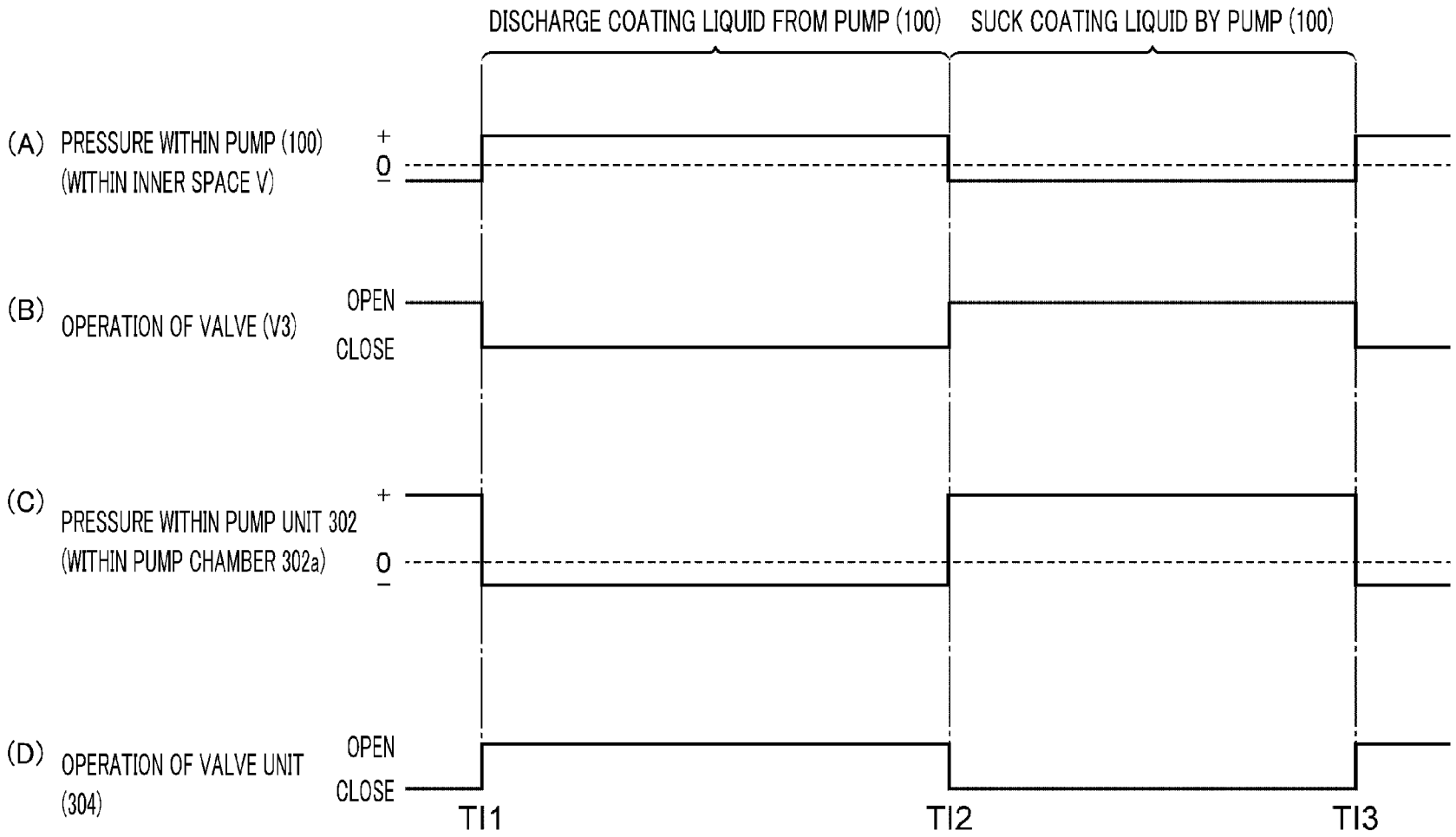
FIG. 13 is a timing chart for describing operations of a pump and an assist pump.

After the discharge of the coating liquid from the pump 100 is completed, at the time point TI2, in a state where the valve V3 is opened (see (B) of FIG. 13), the inside of the inner space V is set to have a negative pressure (see (A) of FIG. 13). Thus, between the time point TI2 and a time point TI3, the air is discharged from the inner space V by the electropneumatic regulator RE and the coating liquid is sucked by the pump 100. At this time, in the assist pump 300, in a state where the valve unit 304 is closed (see (D) of FIG. 13), the pump unit 302 (inside the pump chamber 302*a*) is set to have a positive pressure (see (C) of FIG. 13) and the coating liquid is discharged from the pump unit 302.

In the example illustrated in FIG. 12, the filter device F is arranged at an upstream side of the pump 100. Further, there is a pressure loss between an inlet side and an outlet side of (at a primary side and a secondary side of) the filter device F. As a result, depending on a viscosity of the coating liquid (liquid), the coating liquid may be foamed or a discharge amount of the coating liquid from the pump 100 may be decreased due to lack of suction force of the pump 100. However, in the example illustrated in FIG. 12, since the assist pump 300 is provided on the line D3 between the liquid tank T1 and the filter device F, the coating liquid to which a pressure by the assist pump 300 is applied can be delivered to the filter device F or the pump 100 at the downstream side. For this reason, the coating liquid is likely to have a positive pressure at a downstream side of the assist pump 300. Therefore, even if the pressure of the coating liquid is decreased at the downstream side of the filter device F due to the pressure loss, the coating liquid is likely to have a positive pressure at the downstream side of the filter device F. As a result, even if the liquid has a middle viscosity (for example, 100 cP or more) or a high viscosity (for example, 300 cP or more), it is possible to suppress the discharge amount of the coating liquid from the pump 100 from being decreased or the coating liquid from being foamed while removing the foreign materials in the coating liquid with the filter device F. As a result, it is possible to control an amount of the coating liquid discharged from the pump 100 (nozzle N) with high accuracy. Therefore, it is particularly applicable in the case of handling a coating liquid (a resist liquid for forming a resist pattern) with a demand for high accuracy in a film thickness of a coating film.

Further, if the assist pump 300 is used, it is possible to suppress the coating liquid at the downstream side of the assist pump 300 from being foamed. Therefore, the liquid supply system 40 (liquid delivery system 60) may not include the liquid tank T2.

Figure 14:
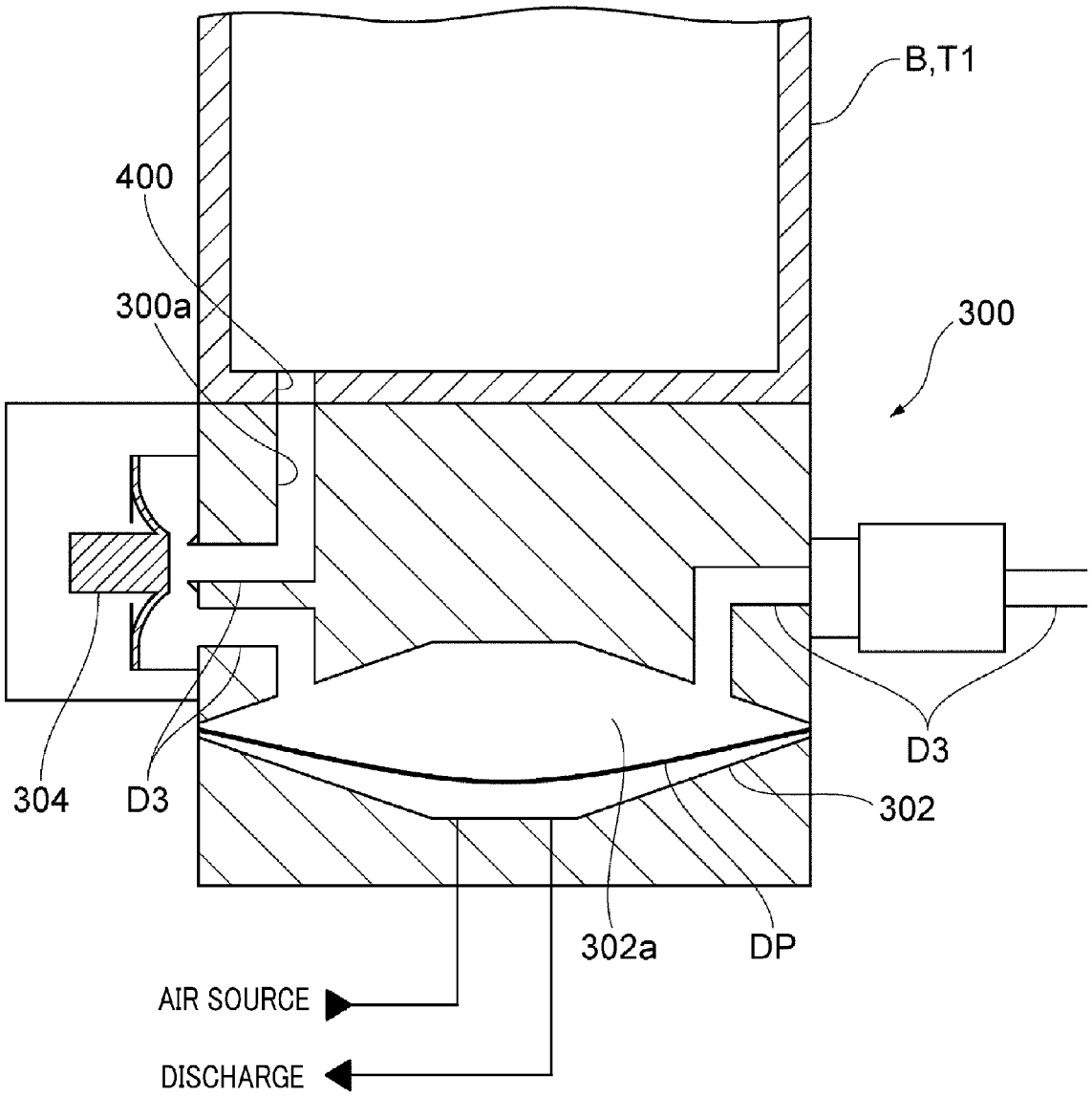
FIG. 14 is a cross-sectional view illustrating mainly an assist pump according to another example.

The assist pump 300 may be positioned at a side of the liquid source rather than the side of the filter device F. To be specific, a length of a passageway (a movement distance of the coating liquid) between the liquid source and the assist pump 300 may be shorter than a length of a passageway (a movement distance of the coating liquid) between the assist pump 300 and the filter device F. As illustrated in FIG. 14, an inlet opening 300*a* of the assist pump 300 for the coating liquid and a discharge opening 400 of the liquid source (the liquid bottle B or the liquid tank T1) for the coating liquid may be formed as one body. If the liquid supply system 40 includes the liquid tank T1, the liquid tank T1 arranged just beside the upstream side of the assist pump 300 serves as the liquid source for the assist pump 300. Therefore, the assist pump 300 and the liquid tank T1 may be configured as one body. By way of example, outer wall surfaces of the assist pump 300 and the liquid tank T1 may be in direct contact with each other. If the liquid supply system 40 does not include the liquid tank T1, the liquid bottle B arranged just beside the upstream side of the assist pump 300 serves as the liquid source for the assist pump 300. Therefore, the assist pump 300 and the liquid bottle B may be configured as one body. By way of example, outer wall surfaces of the assist pump 300 and the liquid bottle B may be in direct contact with each other. Although the assist pump 300 and the liquid source are in direct contact with each other in the example illustrated in FIG. 14, another member may be arranged between the assist pump 300 and the liquid source and configured as one body as a whole.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

We claim:

1. A pump device comprising:

a pump including: a tube, having elasticity, in which a liquid as a target to be delivered flows; a tube housing which covers an outside of the tube and keeps a gas in an inner space between an outer surface of the tube and the tube housing; and a supply/discharge unit configured to supply the gas into the inner space and discharge the gas from the inner space so as to increase or decrease a pressure applied onto the outer surface of the tube, a housing including:

a main part provided with a first connecting member for introducing the liquid into the pump device, and a second connecting member for discharging the liquid to an outside of the pump device; and an extension part which has a smaller thickness than the main part and is extended outwardly from the main part, wherein the pump device is assembled with another pump device by overlapping the extension part of the pump device with another extension part of said another pump device without overlapping the main part of the pump device with another main part of said another pump device, the main part accommodates the supply/discharge unit, the extension part accommodates the tube and the tube housing, and the first connecting member, the second connecting member and the tube constitute a delivery line of the liquid, and the main part is a unitary component, the main part has a hexahedral shape including a pair of main surfaces, a pair of side surfaces and a pair of end surfaces, the main surfaces have a greater area than the side surfaces and the end surfaces, the extension part is extended outwardly in a linear shape from one of the side surfaces of the main part toward an outside of the main part.

2. The pump device of claim 1, wherein the tube includes recessed grooves which are extended along a central axis of the tube and recessed toward the central axis.

3. The pump device of claim 2, wherein the tube is extended to penetrate the tube housing, and a portion of the tube including the recessed grooves is positioned within the tube housing.

4. The pump device of claim 2, wherein the tube includes three recessed grooves, and the three recessed grooves are arranged to be approximately-spaced in a circumferential direction of the tube.

5. A liquid supply system comprising:

the pump device as claimed in claim 1;

a first liquid delivery line connecting the pump to a liquid source;

a second liquid delivery line connecting the pump to a nozzle through which the liquid is discharged; and a third liquid delivery line extended within the pump, wherein at least a portion of the third liquid delivery line is constituted by the tube.

6. The liquid supply system of claim 5, further comprising:

a filter provided on the first liquid delivery line; and an assist pump provided on the first liquid delivery line between the filter and the liquid source.

7. The liquid supply system of claim 6, wherein an inlet opening of the assist pump for the liquid and a discharge opening of the liquid source for the liquid are formed as one body.

* * * * *